US006948303B2

(12) United States Patent
Stahlecker

(10) Patent No.: US 6,948,303 B2
(45) Date of Patent: Sep. 27, 2005

(54) PROCESS AND ARRANGEMENT FOR SPINNING YARN

(75) Inventor: Fritz Stahlecker, Bad Ueberkingen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/783,041

(22) Filed: Feb. 23, 2004

(65) Prior Publication Data

US 2004/0221567 A1 Nov. 11, 2004

Related U.S. Application Data

(63) Continuation of application No. PCT/EP02/06997, filed on Jun. 25, 2002.

(30) Foreign Application Priority Data

Aug. 21, 2001 (DE) ..... 101 41 965

(51) Int. Cl.[7] ..... B65H 69/06

(52) U.S. Cl. ..... 57/22; 57/279; 57/301; 57/304

(58) Field of Search ..... 57/22, 263, 279, 57/301, 304, 315, 328, 333, 350, 400, 403; 15/300.1, 301

(56) References Cited

U.S. PATENT DOCUMENTS 4,787,198 A * 11/1988 Stahlecker ..... 57/401
4,845,936 A 7/1989 Artzt et al.
5,419,110 A 5/1995 Mikami et al.
6,058,693 A 5/2000 Stahlecker et al.
2002/0100269 A1 * 8/2002 Stahlecker ..... 57/403

FOREIGN PATENT DOCUMENTS

| | | |
|---|---|---|
| DE | 197 46 602 | 4/1999 |
| EP | 0 374 982 | 6/1990 |
| GB | 2 178 451 | 2/1987 |

* cited by examiner

*Primary Examiner*—John J. Calvert
*Assistant Examiner*—Shaun R Hurley
(74) *Attorney, Agent, or Firm*—Crowell & Moring LLP

(57) ABSTRACT

A process is disclosed for a spinning arrangement for dealing with the correction of an end break. During operation, sliver-like fiber material fed to the spinning arrangement is opened to single fibers by means of an opening roller. The single fibers are then transferred in the form of a fiber veil to a suctioned collecting surface, which is driven in the direction of motion of the single fibers. During the transport of the fibers by means of the collecting surface, the fiber veil is condensed to a narrow fiber strand and the condensed fiber strand is spun to a yarn downstream of a nipping line by means of a twisting nozzle. When an end-break occurs, the material feed is interrupted and the fiber strand is suctioned in the area of the nipping line until the collecting surface is free from single fibers. A piecing operation subsequently takes place.

24 Claims, 6 Drawing Sheets

PROCESS AND ARRANGEMENT FOR SPINNING YARN

This application is a continuation of International Patent Application No. PCT/EP02/06997 filed on Jun. 25, 2002, designating the United States of American, the entire disclosure of which is incorporated herein by reference. Priority is claimed based on Federal Republic of Germany Patent Application No. 101 41 965.1 filed Aug. 21, 2001.

BACKGROUND AND SUMMARY OF THE INVENTION

The present invention relates to a process for a spinning arrangement for dealing with the correction of an end break in this arrangement, during operation of which sliver-like fiber material fed to the spinning arrangement is opened to single fibers by means of an opening roller, the single fibers are transferred in the form of a fiber veil to a suctioned collecting surface, which is driven in the direction of motion of the single fibers, the fiber veil is condensed to a narrow fiber strand on the collecting surface and the condensed fiber strand is spun to a yarn downstream of a nipping line by means of a twisting nozzle.

A spinning arrangement of the type mentioned is prior art in U.S. Pat. No, 6,058,693. This arrangement functions with a suctioned opening roller, which transfers the single fibers at a relatively low speed and in the form of a fiber veil to a somewhat faster rotating collecting surface, the suction opening arranged thereto tapering in the direction of motion of the collecting surface to such a degree that the single fibers are laterally displaced and the original fiber veil is condensed to a roving-like fiber strand. The condensing process is at an end at the latest at the nipping line and downstream thereof, the fiber strand is imparted a spinning twist by means of a twist nozzle for the production of the yarn. The nipping line acts hereby as a twist block. A yarn is produced which has similar characteristics to yarns produced in so-called airjet spinning, although the drafting unit typical for airjet spinning is not present in this case.

When an end-break occurs in such a spinning arrangement, the interrupted spinning process must be started up again by a piecing process. The known publication does not disclose how the spinning arrangement is operated in the case of an end-break.

It is an object of the present invention to show some possible methods for operating the known spinning arrangement in the case of an end-break. In further embodiments, variations of the piecing process will be shown below.

This object has been achieved in accordance with the present invention in that, in the event of an end-break, the feeding of the fiber material is interrupted and the fiber strand is suctioned in the area of the nipping line until the collecting surface is free of single fibers.

The interruption of the material feed, which is known per se in open-end rotor spinning, is a practical way of preventing the continued feeding of opened single fibers in the form of a fiber veil to the collecting surface, which fibers cannot be subsequently withdrawn. The suctioning of the single fibers and the clearing of the collecting surface serves to avoid further complications during a piecing operation. For the suction, a suction tube can be provided, which can be located upstream or downstream of the nipping line in the direction of motion of the fiber material. A suction tube can either be present at each spinning station or can be placed there by a maintenance arrangement when required. It is, however, practical when a suction tube is arranged to each individual spinning arrangement, which suction tube can be automatically applied to the collecting surface and activated in the case of an end-break.

Subsequently to the carrying out of the preparation as described above, the spinning arrangement can be set in operation again, whereby there are many possible variations for the piecing process.

In a first process to set the spinning arrangement in operation again, the fiber material feed is set in motion again and subsequently the fiber strand is fed by means of the collecting surface and for a given time is again suctioned in the area of the nipping line; the suction is de-activated in order for the fiber strand to be transferred to the twist nozzle. This ensures that when the spinning arrangement is set in operation again, an operational state exists firstly on the collecting surface, in which state the number of the single fibers transported by the collecting surface is known. Only when this state has been achieved is the condensed fiber strand transferred to the twist nozzle.

In a second variation of a process it is provided that after the suction of the fiber strand the drive of the collecting surface is interrupted and subsequently a piecing yarn is drawn backwards—in the opposite direction to the operational delivery direction—through the twist nozzle into the area of the opening roller, where it is disposed on the collecting surface, whereby, in order to set the spinning arrangement in operation again, the fiber material feed is set in motion again and the drive of the collecting surface is taken up again. In this variation, the piecing yarn is already threaded or guided into the twist nozzle, it simply must be guided back into the area of the opening roller. The piecing yarn can come from the winder of the relevant spinning arrangement or it can come from an auxiliary winder which is only used for piecing. The length of the piecing yarn should have a length which can always be reproduced. It is practical in this case to bring the collecting surface to a standstill. Only when the spinning arrangement is set in operation again, is the last end of the piecing yarn disposed onto the collecting surface, namely as soon as the new fiber veil is formed on the collecting surface. In order to feed the piecing yarn back into the area of the opening roller, an auxiliary nozzle is advantageously used which can be applied thereto. In a third piecing process it is provided that subsequent to the suction of the fiber strand, while the collecting surface temporarily rotates in the opposite direction to the operational direction of motion, a piecing yarn is threaded backwards—in the opposite direction to the operational delivery direction-through the twist nozzle to the area of the opening roller, whereby in order to start up the spinning arrangement, the fiber material feed and the drive of the collecting surface in operational direction of motion are all re-activated. The piecing yarn, as in the previously described variation, is already threaded through the twist nozzle, but is transported by the temporarily reversely rotating collecting surface to the area of the opening roller. If required, it could be provided here that the collecting surface together with the suction device arranged thereto be swivelled away a little from the opening roller. As soon as the end of the piecing yarn reaches the area of the opening roller, the fiber material feed can be continued, whereby the collecting surface is driven in its normal operational direction of motion.

These and further objects, features and advantages of the present invention will become more readily apparent from the following detailed description thereof when taken in conjunction with the accompanying drawings.

DETAILED DESCRIPTION OF THE DRAWINGS

Figure 1:
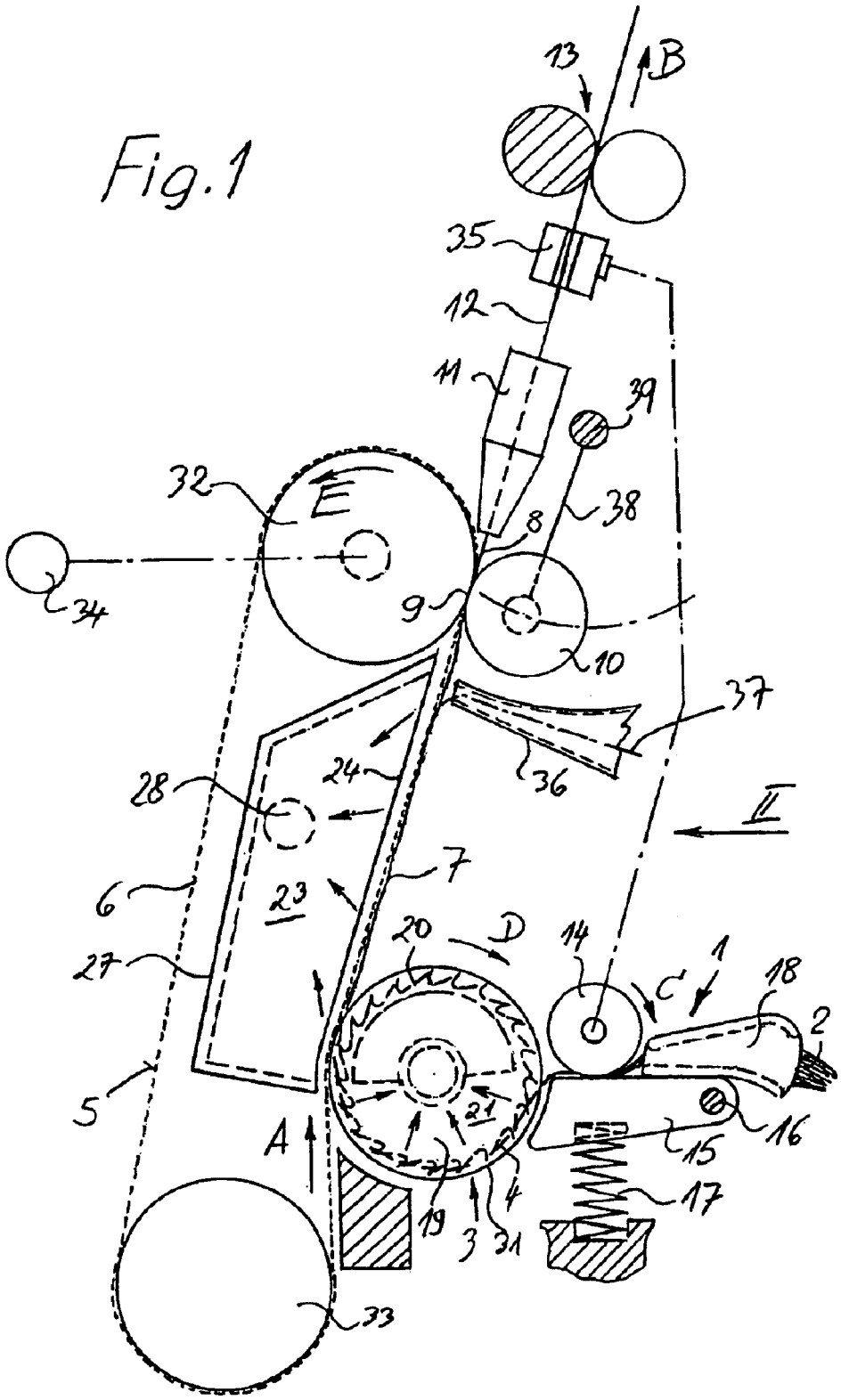
FIG. 1 is a part sectional side view of a spinning arrangement, for which the process according to the present invention illustrated.
Figure 2:
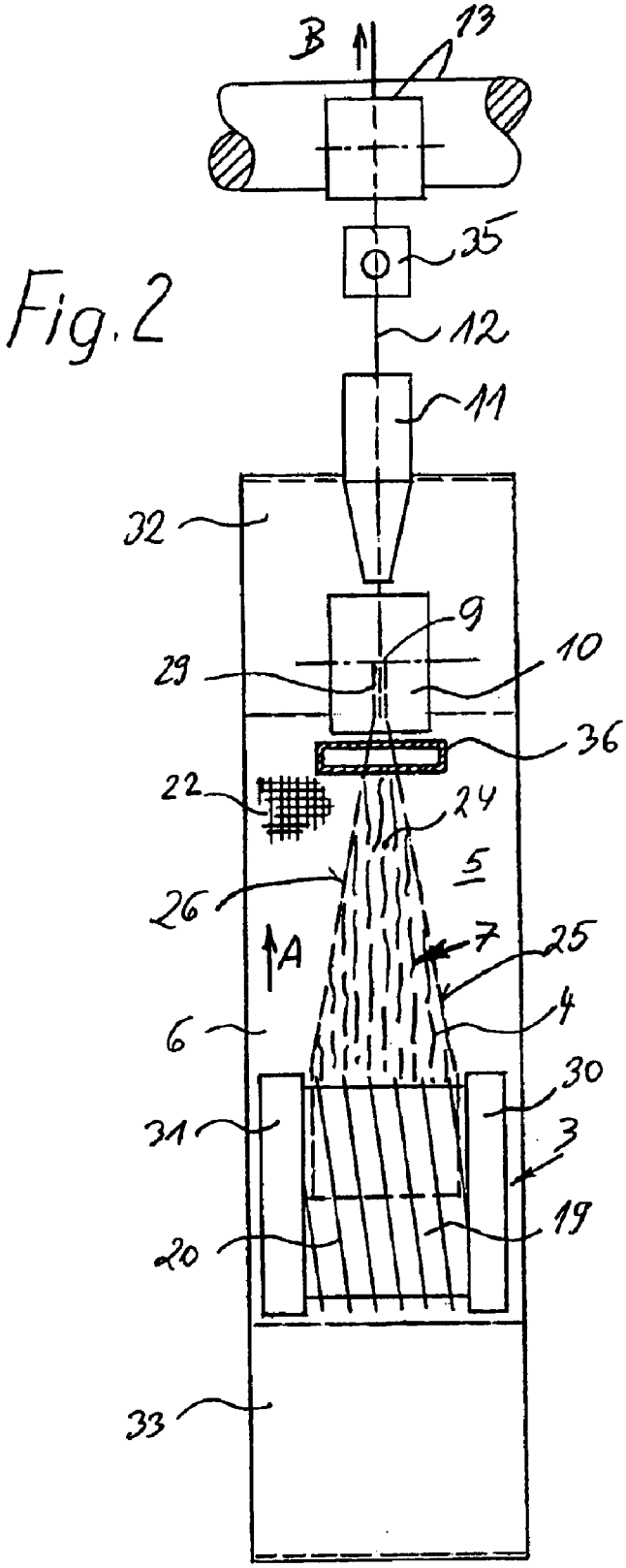
FIG. 2 is a view in the direction of the arrow II of FIG. 1, whereby for reasons of clarity the components located in front of the collecting surface have been omitted.

The spinning arrangement according to FIGS. 1 and 2 comprises a feeding device 1, to which fiber material 2 in the form of at least one sliver is fed. An opening device 3 is arranged downstream of the feeding device 1, which opening device 3 opens the at least one sliver 2 into single fibers 4. The single fibers 4 are subsequently transferred to an air-permeable, suctioned collecting surface 5, which is formed by the outer side of a transport belt 6 which travels in the direction of motion A. The opened single fibers 4 are taken up on the collecting surface 5 in the form of a wide fiber veil 7 and are laterally condensed to a narrow fiber strand 8 in a way to be described below.

The condensed fiber strand 8 is pressed lightly at a nipping line 9 by means of a nipping roller 10 to the collecting surface 5. Directly downstream thereof is a twist nozzle 11, in which the twist for the yarn 12 to be spun is generated. The yarn 12 is withdrawn in delivery direction B by a withdrawal roller pair 13.

The feeding device 1 comprises a feed roller 14 which is driven during the spinning operation in rotational direction C. A feed table 15 is arranged at the feed roller 14, which feed table 15 can be swivelled around a swivel axle 16 and pressed against the feed roller 14 by means of a loading spring 17. An entry funnel 18 for the fed fiber material 2 is arranged upstream of the feed roller 14.

The opening device 3 comprises an opening roller 19, which is driven in the same direction as the feed roller 14, that is, in rotational direction D, and to which opening roller 19 the fiber material 2 is presented in the form of a fiber beard. The circumference of the opening roller 19 has a toothed combing means 20, whose teeth are provided with fronts preferably having a negative angle. The opening roller 19 has an effective width which corresponds to the width of the fed fiber material 2.

In the inside of the opening roller 19, a suction device is located (indicated only schematically) which is connected to a vacuum source (not shown). Due to perforations on the periphery of the opening roller 19, a suction draught is generated against the fiber material 2 to be opened, which sucks the fiber material 2 deep into the toothed combing means 20, even when the opening roller 19 is driven at a relatively low speed of, for example, 2000 rpm. The suctioned area 21 of the opening roller 19 extends over an angle of approximately 180°, that is, as wide an area as is covered by the single fibers 4 on the periphery of the opening roller 19 when they are transported, see the air arrows in FIG. 1.

The transport belt 6 is provided with fine perforations, which permit a suction action from the outside inward. The transport belt 6 is for this purpose advantageously in the form of a woven sieve belt 22. The suction area 23 thereof begins approximately at that point where the suction area 21 of the opening roller 19 ends. The suction opening 24 belonging to the suction area 23 of the transport belt 6 has two side edges 25 and 26, which are denoted by a broken line in FIG. 2. It can be seen that the suction area 23 tapers in the direction of motion A of the transport belt 6. The side edges 25 and 26 of the suction opening 24 form means for condensing the single fibers 4 transversely to their direction of motion to a rovinglike fiber strand 8. The suction opening 24 is arranged in a suction housing 27, which is connected via a conduit 28 to a vacuum source (not shown).

The nipping roller 10 defines with the transport belt 6 the nipping line 9 mentioned above for the condensed fiber strand 8. The suction area 23 has condensed, transversely to its direction of motion, the initially widened fiber veil 7 to the fiber strand 8, as in the case of a classic drafting unit, so that the condensed fiber strand 8 can travel into the twist nozzle 11 in this form, as is known in the case of so-called airjet spinning. This fiber strand 8 is hereby twisted to a yarn 12. The delivery roller pair 13, located downstream of the twisting nozzle 11, delivers the spun yarn 12 in withdrawal direction B to a winding device (not shown), where the yarn 12 is wound onto a crosswound package.

The geometric placing of the spinning arrangement is such that the collecting surface 5 of the transport belt 6 is so closely adjacent to the periphery of the opening roller 19 that the single fibers 4 at the end of the suction area 21 can be transferred in the form of a fiber veil 7 without difficulty to the collecting surface 5. The peripheral speed of the transport belt 6 is greater than the speed of the single fibers 4 as they arrive.

Due to its perforations, the peripheral speed of the opening roller 19 can be less than in the case of opening rollers which are used, for example, in open-end rotor spinning. Because the fiber beard is drawn far into the toothed combing means 20, an intensive combing process takes place. Because of the preferably negative front angle of the teeth, the single fibers 4 are transferred very quickly at the end of the suction area 21 to the collecting surface 5, as a negative front angle strives to deliver the transported single fibers 4 outwards.

The fiber veil 7 disposed on the collecting surface 5 has initially a rather wide width, but is gradually laterally compressed and condensed on the transport belt 6 due to the tapering suction area 23 to such an extent that it can enter the twisting nozzle 11 without difficulty. The lateral edges 25 and 26 of the suction opening 24 extend in a V-shape towards one another so that both lateral edges 25 and 26 form an acute angle to one another. The initial width of the suction opening 24 defines the effective width of the transport belt 6 or the collecting surface 5 and corresponds initially to the initial width of the fiber veil 7 transferred from the opening roller 19. The end area of the suction opening 24 is only a relatively narrow suction slit 29, which is adapted to the fiber strand 8 to be condensed.

As in particular can be seen from FIG. 2, the lateral rims 30 and 31 of the opening roller 19 are designed to be so wide that the transport belt 6 is well supported. These edge rims 30 and 31 ensure that the collecting surface 5 is adapted well to the periphery of the opening roller 19. The diameter of the lateral rims 30 and 31 is somewhat greater than the outer diameter of the toothed combing means 20.

In close proximity to the twist nozzle 11, a front deflecting roller 32 driven in rotational direction E is provided for the transport belt 6, while spatially behind and below the opening roller 19 the transport belt 6 loops a rear deflecting roller 33. The front deflecting roller 32 is connected to a drive 34, which can rotate in both rotational directions.

In a spinning arrangement of the type described above, a spun yarn 12 can, for whatever reason, break during operation. When this happens, it must be ensured that no blockages occur in the spinning arrangement with regard to the fiber material 2 being fed, and furthermore that the operational state of the spinning arrangement can be started up again by means of a piecing process.

Between the twisting nozzle 11 and the delivery roller pair 13, an end-break detector 35 is provided, which preferably monitors the spun yarn 12 in a non-contact way. When a yarn 12 is no longer registered, the detector 35 gives a signal via an electric cable to a coupling connected with the feed roller 14, which signal causes the fed roller 14 to come to a standstill in the case of an end-break, although the remaining spinning elements continue to operate. Thus the feed of the fiber material 2 is immediately interrupted in the case of an end-break.

In the area of the nipping line 9 a suction nozzle 36 is provided, which is not active during the normal spinning process, that is, there is no suction. This suction nozzle 36 can, as shown, be arranged in the direction of motion A upstream of the nipping line 9, or downstream of the nipping line 9, in any case upstream of the twist nozzle 11. The suction nozzle 36 is activated in the case of an end-break, in that either the suction is re-activated or in that the suction nozzle 36 is first placed to the area shown in FIG. 1. It can be provided that the suction nozzle 36 is a component part of a travelling maintenance device (not shown), which becomes active in the case of an end-break.

After an end-break, the fiber strand 8 should be suctioned in the area of the nipping line 9 until the collecting surface 5 is completely free of single fibers 4. This is denoted by the dotdash depiction of a fiber strand 37 being suctioned by the suction nozzle 36. This suction is practical in that when the spinning arrangement is set in operation again, no complications arise regarding blockages caused by fibers.

It is practical for the purpose of the present invention to swivel the nipping roller 10 away from the collecting surface 5 after an end-break has occurred. For this reason, the nipping roller 10 is arranged on a swivel lever 38, which can be swivelled around a swivel axle 39. It is perhaps practical to place the suction nozzle 36 to the nipping line 9 only after the nipping roller 10 has been swivelled.

Figure 3:
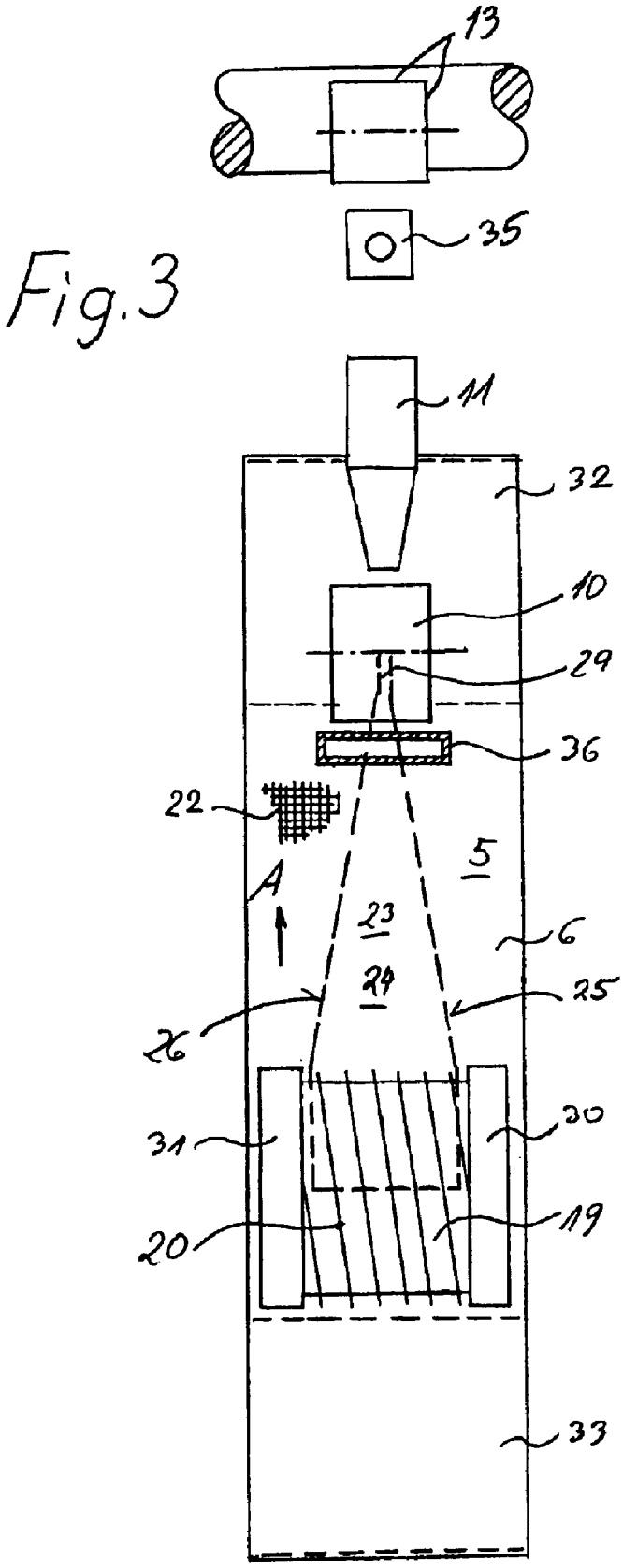
FIG. 3 is a view of FIG. 2, subsequent to an end-break and subsequent to the interruption of the feed of the fiber material.

FIG. 3 shows the state of FIG. 2 subsequent to an end-break and after the fiber strand 37 has been suctioned. It can be seen that in the embodiment according to FIG. 3, no yarn is present and that there is no fiber veil 7 on the collecting surface 5. The collecting surface 5 continues to be driven in direction of motion A, which, however, does not have to be the case. Rather, it could also be provided that after the fiber material has been suctioned, the collecting surface 5 is brought to a temporary standstill for the purpose of correcting the end-break.

Subsequent to the state of the embodiment as shown in FIG. 3, the spinning arrangement must be set in operation again. With the aid of FIGS. 4, 5 and 6, three different procedures are described below.

Figure 4A:
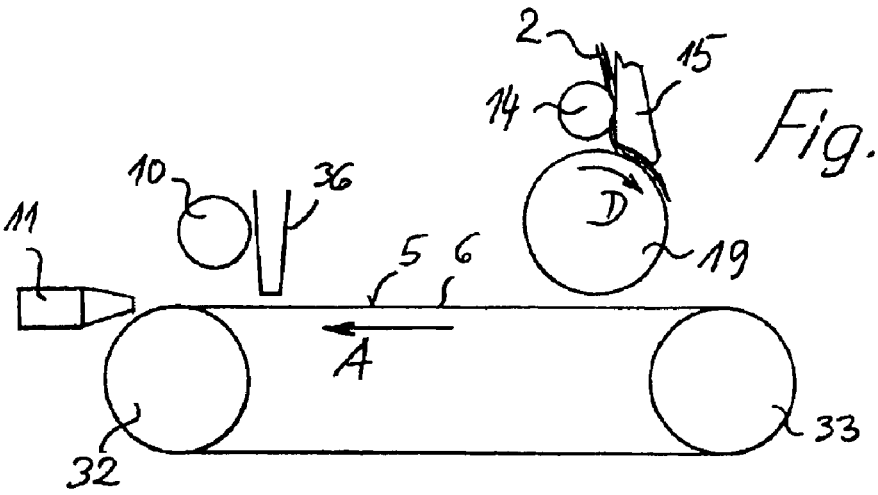
FIGS. 4 to 6 show three different variations for starting up the spinning process after an end break.
Figure 4B:
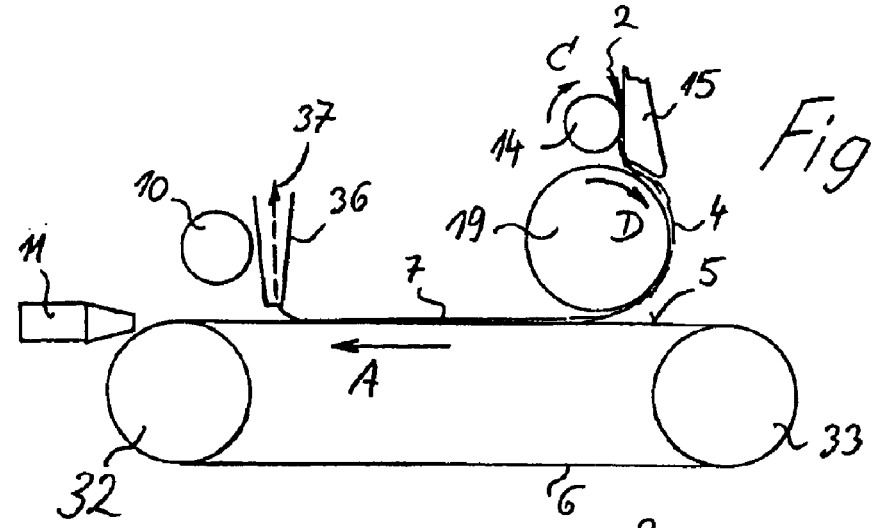

FIG. 4A corresponds to the embodiment shown in FIG. 3, but from another point of view. The feed roller 14 is at a standstill, so that the feed of fiber material 2 to the collecting surface 5 is interrupted, although the transport belt 6 continues to be driven in the direction of motion A. The fiber material located previously on the collecting surface 5 has already been suctioned off via the suction nozzle 36. The opening roller 19 continues, as a rule, to rotate, but can also alternatively be stopped. The nipping roller 10 is raised from the collecting surface 5.

Figure 4C:
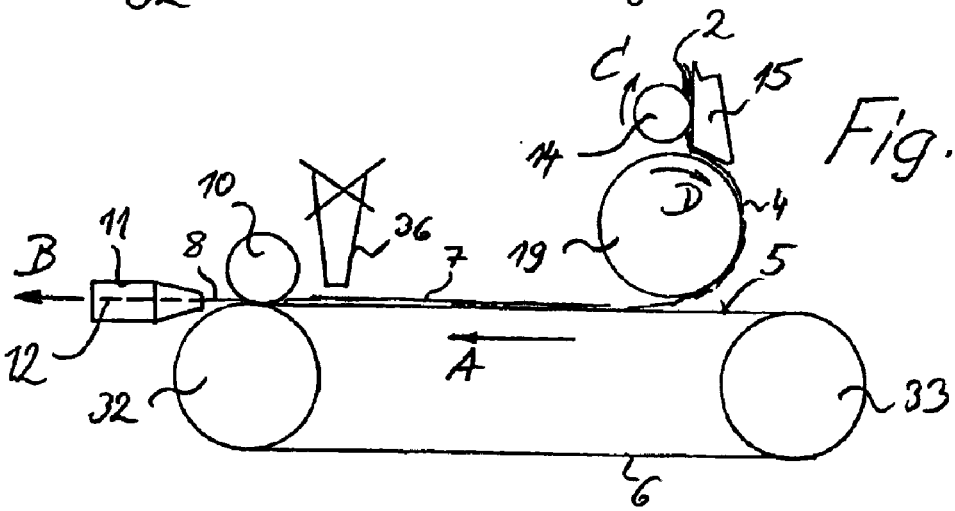

In order for the spinning arrangement to be set in operation again, the feed roller 14 is again driven in rotational direction C as shown schematically in FIG. 413, so that fiber material 2 is again opened to single fibers 4 by the opening roller 19 and transferred as a fiber veil 7 to the collecting surface 5. The newly fed fiber strand 37 is however initially suctioned again for a certain length of time in the area of the nipping roller 10, until it can be presumed that in the area of the opening roller 19 and the collecting surface 5, conditions have been generated which correspond to the normal operational state. Thereafter, the nipping roller 10 is lowered and the suction action of the suction nozzle 36 is interrupted. This state is shown in FIG. 4C. The condensed fiber strand 8 can now run into the twist nozzle 11 again without the suction nozzle 36 having any effect thereon and subsequently the yarn 12 can be transported further in delivery direction B.

FIG. 5, which consists of Figures parts 5A, 5B and 5C, describes another process for setting the spinning arrangement in operation again.

Figure 5A:
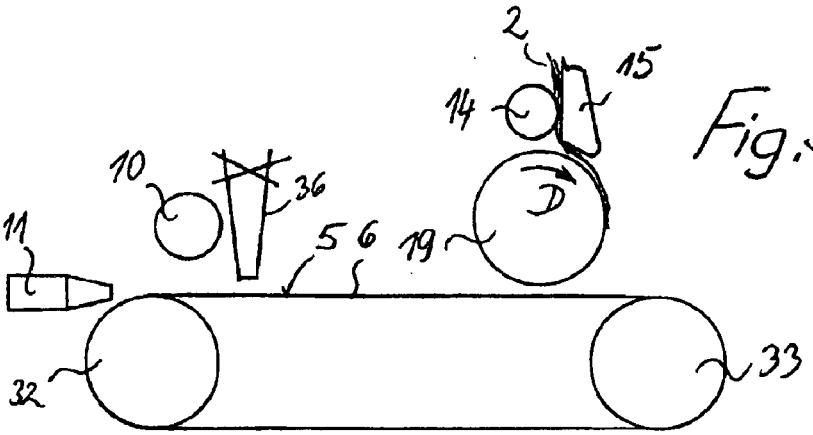

According to FIG. 5A, the nipping roller 10 is again raised from the collecting surface 5 and the feed roller 14 is at a standstill. The fiber material is already suctioned from the collecting surface 5, then the suction action of the suction nozzle 36 interrupted. Deviating from the previously described variation, however, the transport belt 6 is here temporarily brought to a standstill.

Figure 5B:
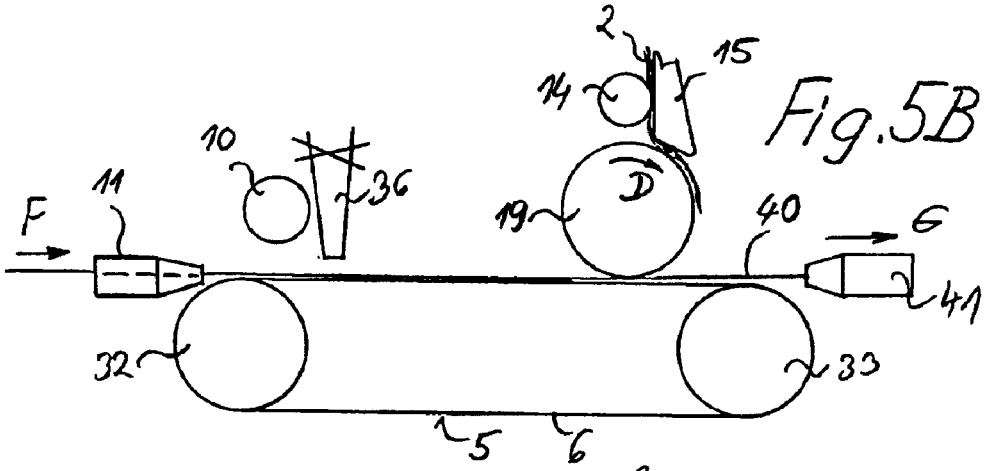

Subsequently, according to FIG. 5B, a piecing yarn 40 is guided backwards, in the opposite direction to the delivery direction B, that is, in direction F, through the twist nozzle 11 into the area of the opening roller 19. An auxiliary nozzle 41 can be provided for this purpose, which is movable according to the arrow direction G The required consistent length of the piecing yarn 40 is laid hereby for this purpose from the side into the spinning arrangement. The piecing yarn 40 can be taken from from the operational crosswound package or from an auxiliary bobbin transported by the maintenance device.

Figure 5C:
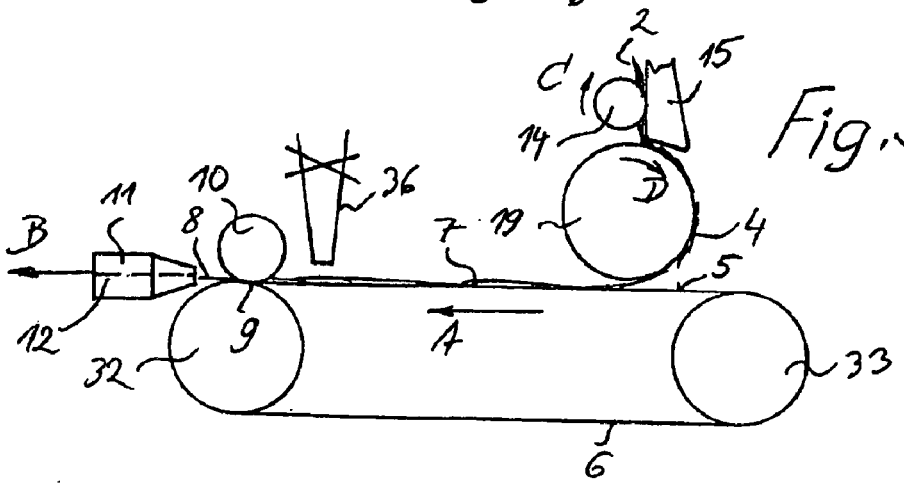

According to FIG. 5C, the feed roller 14 is now set in motion again, so that from the opening roller 19, opened single fibers 4 are again disposed in the form of a fiber veil 7 onto the collecting surface 5. For this purpose, the transport belt 6 is again driven in the direction of motion A. The fiber strand 8 which has been condensed up to the nipping line 9—the nipping roller 10 has been lowered again—travels together with the piecing yarn 40 again in the delivery direction B into the twist nozzle 11. In the case of this method it is important that the piecing yarn 40 has a defined length so that when single fibers 4 again reach the piecing yarn 40, which is withdrawn in delivery direction B, no thickened or thinned areas occur. The suction nozzle 36 is de-activated during this whole piecing process.

A third piecing possibility is described below with the aid of FIG. 6, which again consists of part FIGS. 6A, 6B and 6C.

Figure 6A:
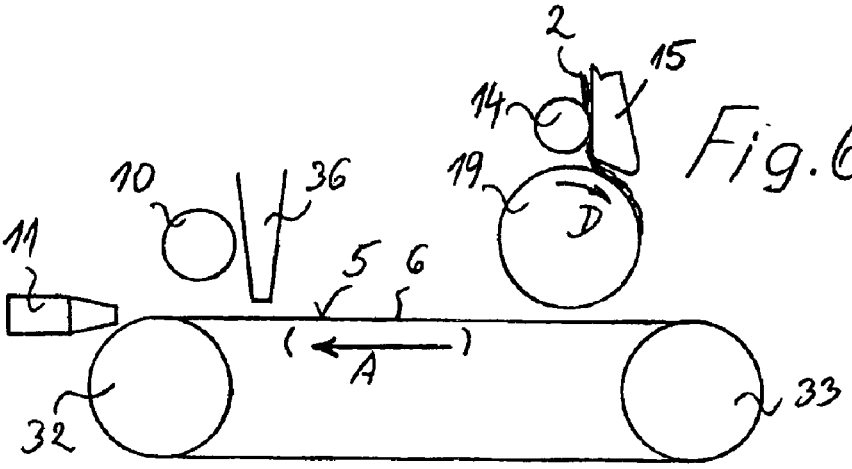

According to FIG. 6A the feed roller 14 is at a standstill, and the suction nozzle 36 has suctioned fiber material from the collecting surface 5. The collecting surface 5 can either initially continue to rotate in the direction of motion B, or it can be brought to a standstill after the fiber material has been suctioned from the collecting surface 5.

Figure 6B:
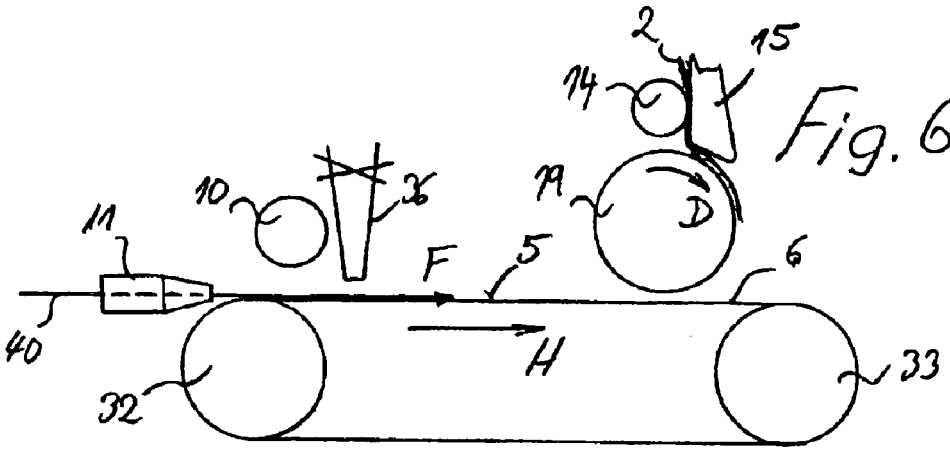
Figure 6C:
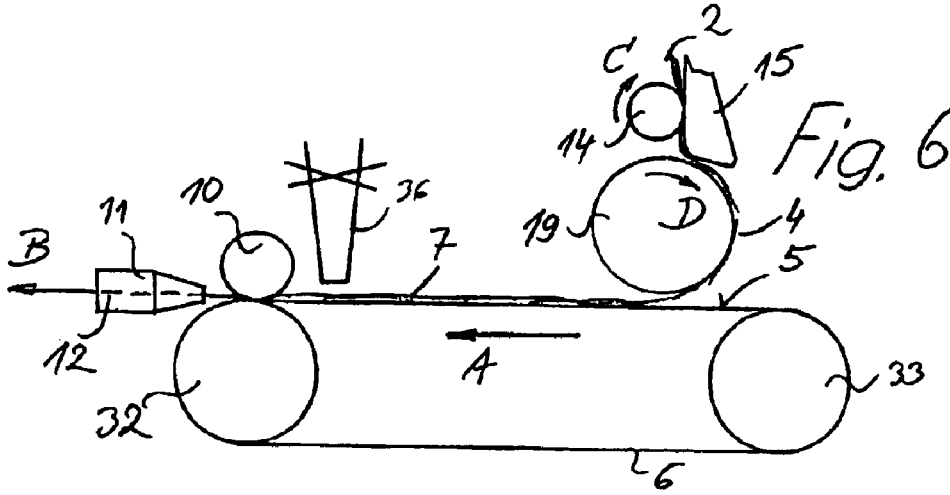

According to FIG. 6B, a piecing yarn 40 is threaded backwards in the opposite direction to the operational direction B into the twist nozzle 11 and guided backwards in direction F to the area of the opening roller 19, the suction nozzle 36 being inactive. In order for the piecing yarn 40 to be guided backwards, the collecting surface 5 is used as an aid, which now rotates temporarily in the opposite direction to the normal operation direction A, that is, in direction H. Thus the end of the piecing yarn 40 reaches the area of the opening roller 19.

It can be provided that the piecing yarn 40 is disposed on the transport belt 6 by means of an auxiliary nozzle (not shown).

As soon as the piecing yarn 40 has reached the area of the opening roller 19, the feed roller 14 can be driven again. At the same time, the transport belt 6 receives its drive in direction of motion A. The single fibers 4 opened by the opening roller 19 again reach the collecting surface 5 in the form of a fiber veil 7, and, subsequent to the nipping roller 10 being lowered, a yarn 12 is spun which is again fed in delivery direction B to a delivery roller pair 13 (not shown).

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for a spinning arrangement for dealing with the correction of an end break in this arrangement, during the operation of which sliver-like fiber material fed to the spinning arrangement is opened to single fibers by means of an opening roller, the single fibers are transferred in the form of a fiber veil to a suctioned collecting surface, which is driven in the direction of motion of the single fibers, the fiber veil is condensed to a narrow fiber strand on the collecting surface and the condensed fiber strand is spun to a yarn downstream of a nipping line by means of a twisting nozzle, wherein, in the case of an end-break, the feed of fiber material is interrupted and the fiber strand is suctioned in the area of the nipping line until the collecting surface is free of single fibers.

2. A process according to claim 1, wherein, in order to set the spinning arrangement in operation again, the feed of fiber material is set in motion again and subsequently the newly fed fiber strand, which is fed over the collecting surface, is again suctioned for a specific length of time in the area of the nipping line and then, for the transfer of the fiber strand to the twist nozzle, the suction action is de-activated.

3. A process according to claim 1, wherein, subsequent to the suctioning of the fiber strand, the drive of the collecting surface is interrupted and subsequently a piecing yarn is threaded backwards in the opposite direction to the operational delivery direction through the twist nozzle to the area of the opening roller and disposed onto the collecting surface, whereafter in order to set the spinning arrangement in operation again the feed of fiber material is set in motion again and the drive for the collecting surface is activated again.

4. A process according to claim 1, wherein subsequent to the suctioning of the fiber strand while the collecting surface is rotating temporarily in the opposite direction to the operational direction of motion, a piecing yarn is guided backwards in the opposite direction to the operation delivery direction through the twist nozzle to the area of the opening roller, where in order to set the spinning arrangement in operation again the feed of fiber material is set in motion and the drive of the collecting surface is set in operational direction of motion again.

5. A process according to claim 3, wherein the guiding backwards of the piecing yarn is supported by an auxiliary nozzle.

6. A process according to claim 4, wherein the guiding backwards of the piecing yarn is supported by an auxiliary nozzle.

7. A process for repairing a yarn end break in a spinning arrangement which includes:

a feeding device operable to feed a fiber silver, an opening device disposed downstream of the feeding device and operable to open said fiber silver into single fibers, a movable collecting surface disposed downstream of the opening device and operable to receive the single fibers from the opening device in the from of a fiber veil which is condensed to a fiber strand as it is transported by the collecting surface in a first normal spinning direction, a nipping line disposed at a downstream end of the collecting surface fiber veil travel path, and a twisting device disposed downstream of the nipping line and operable to twist the condensed fiber strand to form yarn, said process comprising:

interrupting feed of fiber silver by the feeding device in an event of a broken yarn end, and removing the fiber strand from the collecting surface by applying suction in an area of the nipping line until the collecting surface is substantially free of fibers.

8. A process according to claim 7, wherein, in order to set the spinning arrangement in operation again, the feed of fiber material is set in motion again and subsequently the newly fed fiber strand, which is fed over the collecting surface, is again suctioned for a specific length of time in the area of the nipping line and then, for the transfer of the fiber strand to the twisting device, the suction action is de-activated.

9. A process according to claim 7, wherein subsequent to the suctioning of the fiber strand, the drive of the collecting surface is interrupted and subsequently a piecing yarn is guided backwards in the opposite direction to the operational delivery direction through the twisting device to the area of the opening roller and disposed onto the collecting surface, whereafter in order to set the spinning arrangement in operation again the feed of fiber material is set in motion again and the drive for the collecting surface is activated again.

10. A process according to claim 7, wherein subsequent to the suctioning of the fiber strand while the collecting surface is rotating temporarily in the opposite direction to the operational direction of motion, a piecing yarn is guided backwards in the opposite direction to the operation delivery direction through the twisting device to the area of the opening roller, where in order to set the spinning arrangement in operation again the feed of fiber material is set in motion and the drive of the collecting surface is set in operational direction of motion again.

11. A process according to claim 9, wherein the guiding backwards of the piecing yarn is supported by an auxiliary nozzle.

12. A process according to claim 10, wherein the guiding backwards of the piecing yarn is supported by an auxiliary nozzle.

13. A process according to claim 7, wherein the opening device is an opening roller.

14. A process according to claim 7, wherein the twisting device is a twist nozzle.

15. A process according to claim 7, wherein the collecting surface is perforated and condensing of the fiber veil utilizes a suction device acting on the collecting surface.

16. Apparatus for repairing a yarn end break in a spinning arrangement which includes:

a feeding device operable to feed a fiber silver, an opening device disposed downstream of the feeding device and operable to open said fiber silver into single fibers, a movable collecting surface disposed downstream of the opening device and operable to receive the single fibers from the opening device in the from of a fiber veil which is condensed to a fiber strand as it is transported by the collecting surface in a first normal spinning direction, a nipping line disposed at a downstream end of the collecting surface fiber veil travel path, and a twisting device disposed downstream of the nipping line and operable to twist the condensed fiber stand to form yarn, said apparatus comprising:

means for interrupting feed of fiber silver by the feeding device in an event of a broken yarn end, and means for removing the fiber strand from the collecting surface by applying suction in an area of the nipping line until the collecting surface is substantially free of fibers.

17. Apparatus according to claim 16, wherein means are provided to set the spinning arrangement in operation again, and wherein, in order to set the spinning arrangement in operation again, the feed of fiber material is set in motion again and subsequently the newly fed fiber strand, which is fed over the collecting surface, is again suctioned for a specific length of time in the area of the nipping line and then, for the transfer of the fiber strand to the twisting device, the suction action is de-activated.

18. Apparatus according to claim 16, wherein means are provided to set the spinning arrangement in operation again, and wherein, subsequent to the suctioning of the fiber strand, the drive of the collecting surface is interrupted and subsequently a piecing yarn is guided backwards in the opposite direction to the operational delivery direction through the twisting device to the area of the opening roller and disposed onto the collecting surface, whereafter in order to set the spinning arrangement in operation again the feed of fiber material is set in motion again and the drive for the collecting surface is activated again.

19. Apparatus according to claim 18, wherein means are provided to set the spinning arrangement in operation again, and wherein, subsequent to the suctioning of the fiber strand while the collecting surface is rotating temporarily in the opposite direction to the operational direction of motion, a piecing yarn is guided backwards in the opposite direction to the operation delivery direction through the twisting device to the area of the opening roller, where in order to set the spinning arrangement in operation again the feed of fiber material is set in motion and the drive of the collecting surface in set in operational direction of motion again.

20. Apparatus according to claim 18, wherein the guiding backwards of the piecing yarn is supported by an auxiliary nozzle.

21. Apparatus according to claim 19, wherein the guiding backwards of the piecing yarn is supported by an auxiliary nozzle.

22. Apparatus according to claim 16, wherein the opening device is an opening roller.

23. Apparatus according to claim 16, wherein the twisting device is a twist nozzle.

24. Apparatus according to claim 16, wherein the collecting surface is perforated and condensing of the fiber veil utilizes a suction device acting on the collecting surface.

* * * * *